United States Patent [19]

Swift

[11] 4,153,496

[45] May 8, 1979

[54] LABEL MANUFACTURING APPARATUS

[75] Inventor: Kenneth J. Swift, Keene, N.H.

[73] Assignee: Markem Corporation, Keene, N.H.

[21] Appl. No.: 881,555

[22] Filed: Feb. 27, 1978

[51] Int. Cl.[2] ..... B41F 19/00

[52] U.S. Cl. ..... 156/384; 156/248; 156/267; 156/268; 156/269; 156/289; 156/511; 156/517; 156/527

[58] Field of Search ..... 156/247, 248, 252, 267, 156/268, 269, 289, 323, 511, 517, 519, 527, 384; 40/2 R; 428/352

[56] References Cited

U.S. PATENT DOCUMENTS

| | | | |
|---|---|---|---|
| 2,303,346 | 12/1942 | Flood | 156/267 |
| 2,304,787 | 12/1942 | Avery | 156/268 |
| 2,608,503 | 8/1952 | Meyer | 156/519 |
| 2,805,183 | 9/1957 | Higgins | 156/268 |
| 3,505,140 | 4/1970 | Dunn | 156/289 |

*Primary Examiner*—Caleb Weston

[57] ABSTRACT

Apparatus for manufacturing a continuous strip carrying individual pressure sensitive adhesive labels having permanently mounted pressure sensitive adhesive transparent hinged covers with release sheets thereon for protectively covering information subsequently added to the label.

4 Claims, 5 Drawing Figures

FIG 1
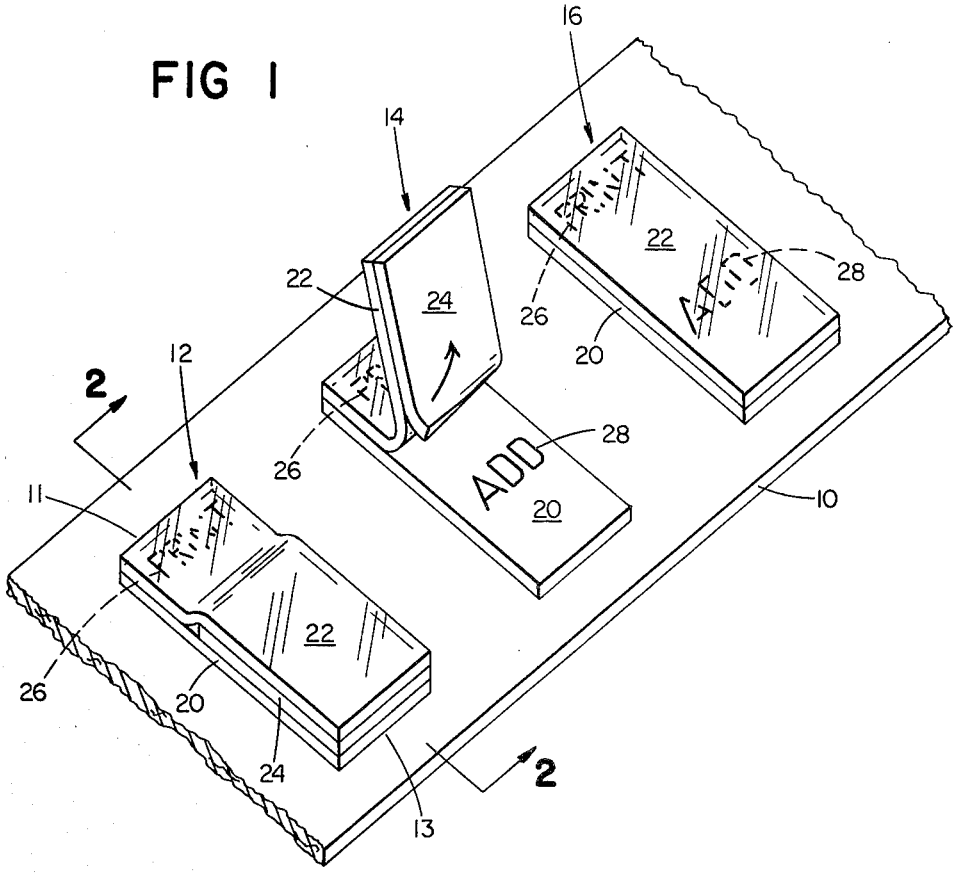
FIG 2
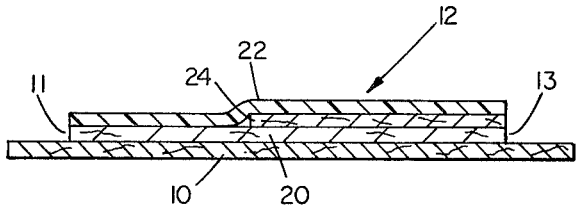
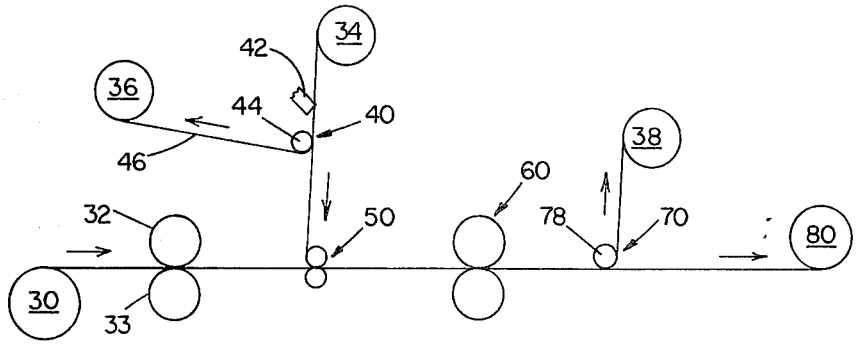
FIG 3

LABEL MANUFACTURING APPARATUS

This invention relates to apparatus for manufacturing adhesive labels and, more particularly, for manufacturing a continuous strip carrying individual pressure sensitive adhesive labels having permanently mounted pressure sensitive adhesive transparent hinged covers with release sheets thereon for protectively covering information subsequently added to the label.

There has long been a need for an adhesive label, especially a printed one, to which specific information may subsequently be added and protected by a transparent cover. However, the manufacture of such a label in continuous strip form has proved to be difficult and, at best, as shown in U.S. Pat. No. 2,953,865, has only provided a label which must be disassembled into separate pieces for use and then reassembled. Since it is difficult to achieve accurate alignment in reassembly, such labels are not really practical in actual use.

Accordingly, it is an object of the present invention to provide novel apparatus not subject to the above noted problems, by which a unitary label of the protective cover type may be provided which does not require disassembly and reassembly for use.

It is another object of the invention to provide novel apparatus for manufacturing such labels in continuous strip form adhered as individual labels to a continuous strip release sheet.

The present invention provides novel apparatus for manufacturing a continuous strip carrying individual pressure sensitive adhesive labels, having permanently mounted pressure sensitive adhesive transparent hinged covers with release sheets thereon for protectively covering information subsequently added to the label, from a continuous strip base sheet having a pressure sensitive adhesive surface with a continuous strip base release sheet adhered thereto and a continuous strip transparent cover sheet having a pressure sensitive adhesive surface with a continuous strip cover release sheet adhered thereto.

The apparatus, in general, comprises cover sheet slitting means, laminating means, cutting means and, preferably, separating means.

The cover sheet slitting means continuously slits only the cover release sheet and removes at least one edge portion thereof to expose at least one edge portion of the pressure sensitive adhesive surface of the transparent cover sheet while maintaining a portion of the cover release sheet thereon.

The laminating means laminates the transparent cover sheet and the maintained portion of its release sheet to the face of the base sheet by adhering thereto the pressure sensitive adhesive surface edge portion of the transparent cover sheet, with the maintained portion of the cover release sheet interposed between the transparent cover sheet and the face of the base sheet.

The cutting means cuts individual labels, preferably spaced from one another and within the margins of the laminated sheets, on the continuous base sheet release strip by cutting through only the transparent cover sheet, its release sheet and the base sheet, with the cover release sheet extending to one of the edges of the labels and being spaced from the other edge of the labels. The individual labels have the transparent cover sheet adhered directly to a portion only of the labels with the cover release sheet interposed therebetween in another portion extending to an edge of the labels for subsequently adding information to the other portion and protecting the added information by removing the cover release sheet and adhering the transparent cover sheet directly to the other portion to cover the added information.

For the purpose of more fully describing the above and still further objects and features of the invention, reference is now made to the following detailed description of a preferred embodiment thereof, together with the accompanying drawings, wherein:

FIG. 1 is an isometric view of a continuous strip carrying individual longitudinally spaced printed pressure sensitive adhesive labels as manufactured by the apparatus of the invention;

FIG. 2 is a cross-sectional view of one of the labels of FIG. 1, taken on the line 2—2 thereof;

FIG. 3 is a diagrammatic side view of apparatus according to the present invention;

Figure 4:
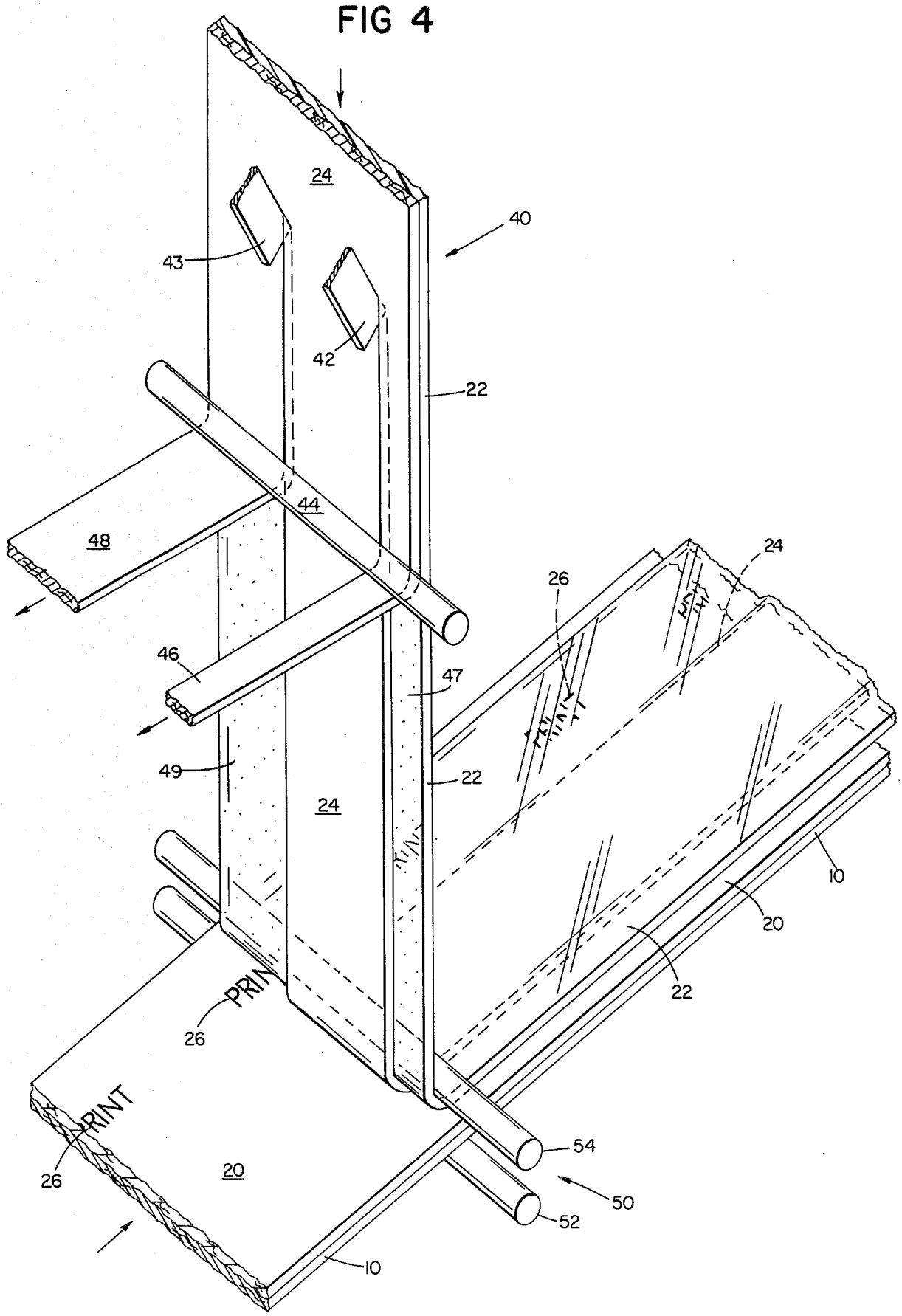
FIG. 4 is an enlarged isometric view of a portion of the apparatus of FIG. 3.

Referring to the drawings, and particularly to FIGS. 1 and 2 thereof, the individual labels are shown carried on a continuous strip base release sheet 10. As manufactured according to the present invention, the label, generally designated 12, has a base sheet 20, a transparent cover sheet 22 and a cover release sheet 24 interposed therebetween. Base sheet 20 has on its lower face in contact with release sheet 10 a suitable pressure sensitive adhesive of a type well known in the art and on its upper face printed matter 26. Printed matter 26 may or may not be present and may extend throughout base sheet 20 or be limited to one or more portions thereof as may be desired to accomplish the particular purpose for which the label is intended. Transparent cover sheet 22 also has on its lower face a suitable pressure sensitive adhesive and is adhered by it directly to a portion only of base sheet 20, herein shown as over printed matter 26. Cover release sheet 24 is interposed therebetween in another portion extending to an edge of base sheet 20 for subsequently adding information, as at 28.

In use, either with the label remaining on base release sheet 10, as shown, or removed from it, the portion of transparent cover sheet 22 over its release sheet 24 may be bent back, the desired additional information added as at 28 and cover release sheet 24 peeled off, as shown by the arrow on label 14 in FIG. 1. With cover release sheet 24 removed, transparent cover sheet 22 may be adhered directly to base sheet 20 to cover and so protect the added information 28, as shown on label 16 in FIG. 1. Since transparent cover sheet 22 remains at all times permanently hingedly mounted on base sheet 20, there exists no problem of aligning it in order to cover and protect the added information.

Figure 5:
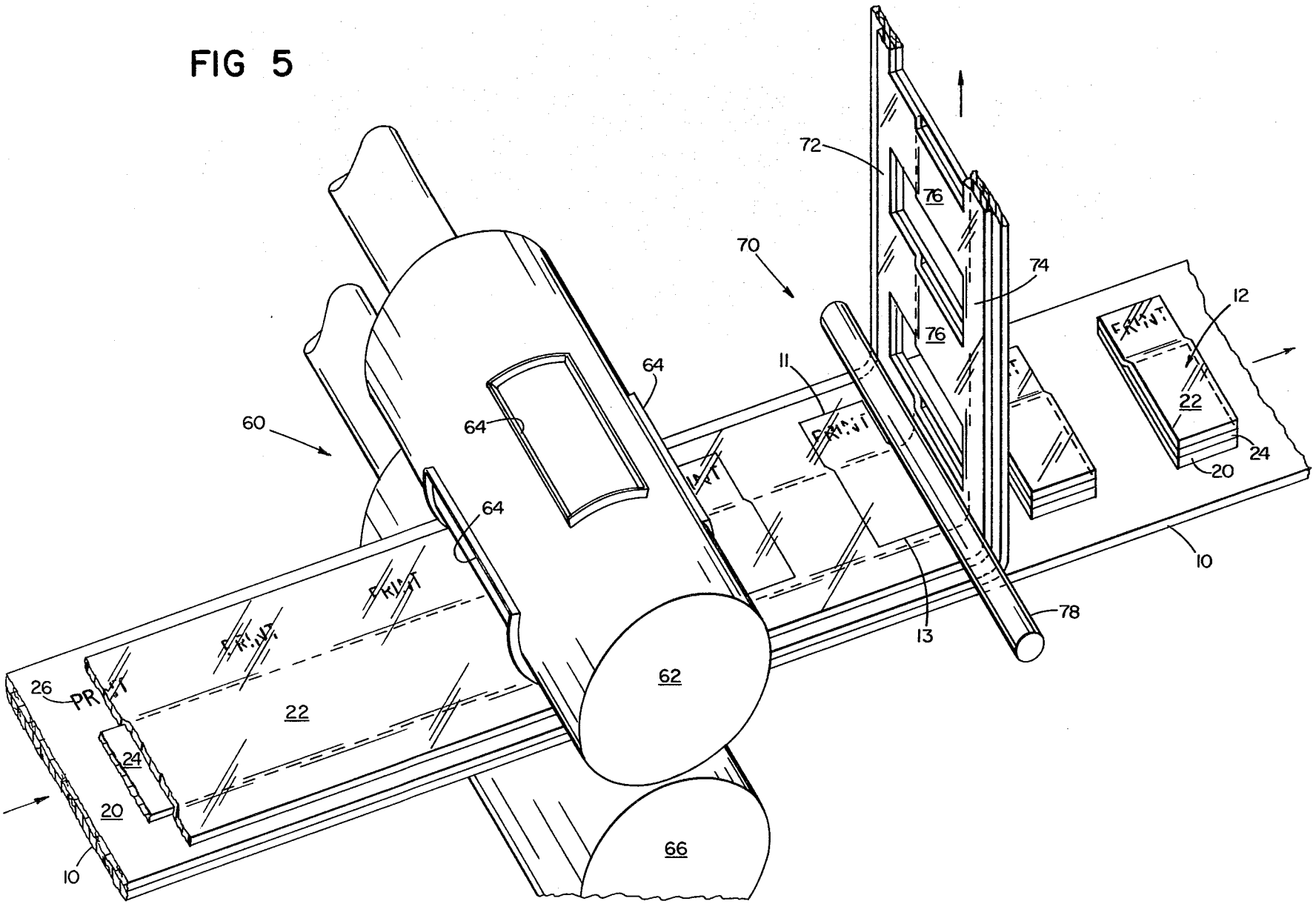
FIG. 5 is an enlarged isometric view of another portion of the apparatus of FIG. 3.

The apparatus of the invention is diagrammatically shown in FIG. 3, with enlarged showings of portions thereof being shown in FIGS. 4 and 5. In general, it includes a source, such as roll 30, of continuous strip base sheet 20 with its continuous strip base release sheet 10 adhered thereto, together with printing roll 32 and backup roll 33 therefor; a source, such as roll 34, of continuous strip transparent cover sheet 22 with continuous strip cover release sheet 24 adhered thereto; a cover sheet slitting device, generally designated 40 and best shown in FIG. 4; a laminating device, generally designated 50, also best shown in FIG. 4; a cutting device, generally designated 60 and best shown in FIG.

5; and a separating device, generally designated 70 and also best shown in FIG. 5. Also provided are waste takeup rolls 36 and 38 for slitting device 40 and separating device 70, respectively. Finished product takeup roll 80 is provided for winding up the finished product of individual labels 12 on continuous strip base release sheet 10.

Referring to the diagrammatic showing of FIG. 4, slitting device 40 includes a suitably mounted, transversely spaced pair of slitting knives 42 and 43 for continuously slitting only through cover release sheet 24 inwardly of the marginal edges thereof to provide opposite edge portions 46 and 48. Edge portions 46 and 48 are then removed by passing them around bar 44 and winding them up on waste roll 36 (FIG. 3). This exposes opposite edge portions 47 and 49 of the pressure sensitive adhesive surface of transparent cover sheet 22 while maintaining a central portion 24 thereon.

Again referring to FIG. 4, laminating device 50 has a pair of nip rolls 52 and 54 for pressure laminating transparent cover sheet 22 and the central portion of its release sheet 24 to the printed face of base sheet 20 by adhering thereto pressure sensitive adhesive surface edge portions 47 and 49, with edge portion 49 covering the printed indicia 26 on base sheet 20 on one marginal edge thereof, with the central portion of cover release sheet 24 interposed between transparent cover sheet 22 and the central portion of base sheet 20 and with edge portion 47 adhered to the opposite marginal edge portion of base sheet 20.

Referring now to the diagrammatic showing of FIG. 5, the laminated continuous strip material from laminating device 50 is then moved to cutting device 60 which consists of cutting roll 62 having a plurality of spaced label defining dies 64 and a backup roll 66 for cutting individual labels 12 spaced from one another on continuous base sheet release strip 10 and within the margins thereof by cutting through only transparent cover sheet 22, its release sheet 24 and base sheet 20 to produce a continuous interconnected laminated waste strip consisting of marginal portions 72 and 74 connected by transverse portions 76. After cutting, the remaining central portion of cover release strip 24 within the cut bounds of each label 12 extends to one of the longitudinal edges 11 of each label 12 and is spaced from the other edge 13 of said labels, for permanent hinged mounting of transparent cover sheet 22 on base sheet 20 of each label 12.

Also in FIG. 5 is shown separating device 70, consisting of a bar 78 around which is passed the continuous waste strip which is then wound up on roll 38 (FIG. 3). The finished product, consisting of individual labels 12 longitudinally spaced from one another on continuous release strip 10, are then wound up on finished product takeup roll 80 (FIG. 3).

It will be apparent to those skilled in the art that various modifications may be made within the spirit of the invention and the scope of the appended claims. For example, instead of apparatus as specifically described herein, intermittent operation with an intermittent die type of printer and cutter could also be utilized.

What is claimed is:

1. Apparatus for manufacturing a continuous strip carrying individual permanently mounted pressure sensitive adhesive labels, having pressure sensitive adhesive transparent hinged covers with release sheets thereon for protectively covering information subsequently added to the label, from a continuous strip base sheet having a pressure sensitive adhesive surface with a continuous strip base release sheet adhered thereto and a continuous strip transparent cover sheet having a pressure sensitive adhesive surface with a continuous strip cover release sheet adhered thereto, said apparatus comprising cover sheet slitting means for continuously slitting only said cover release sheet and removing at least one edge portion thereof to expose at least one edge portion of the pressure sensitive adhesive surface of said transparent cover sheet while maintaining a portion of said cover release sheet thereon laminating means for laminating said transparent cover sheet to the face of said base sheet by adhering thereto the pressure sensitive adhesive surface edge portion of said transparent cover sheet, with said maintained portion of said cover release sheet interposed between said transparent cover sheet and the face of said base sheet and cutting means for cutting individual labels on said continuous base sheet release strip by cutting through only said transparent cover sheet, its release sheet and said base sheet and with said cover release sheet extending to one of the edges of said labels and being spaced from the other edge of said labels, said individual labels having said transparent cover sheet adhered directly to a portion only of said labels with said cover release sheet interposed therebetween in another portion extending to an edge of said labels for subsequently adding information to said other portion and protecting said added information by removing said cover release sheet and adhering said transparent cover sheet directly to said other portion to cover said added information.

2. Apparatus as claimed in claim 1, further comprising printing means for printing label indicia on said base sheet and wherein said individual labels have said transparent cover sheet adhered directly to a portion of said labels carrying said printed label indicia for protection thereof.

3. Apparatus for manufacturing a continuous strip carrying individual longitudinally spaced printed pressure sensitive adhesive labels, having permanently mounted pressure sensitive adhesive transparent hinged covers with release sheets thereon for protectively covering information subsequently added to the label, from a continuous strip base sheet having a pressure sensitive adhesive surface with a continuous strip base release sheet adhered thereto and a continuous strip transparent cover sheet having a pressure sensitive adhesive surface with a continuous strip cover release sheet adhered thereto, said apparatus comprising cover sheet slitting means for continuously slitting only said cover release sheet and removing opposite edge portions thereof to expose opposite edge portions of the pressure sensitive adhesive surface of said transparent cover sheet while maintaining a central portion of said cover release sheet thereon laminating means for laminating said transparent cover sheet to the printed face of said base sheet by adhering thereto the pressure sensitive adhesive surface edge portions of said transparent cover sheet, with said central portion of said cover release sheet interposed between said transparent cover sheet and the face of said base sheet cutting means for cutting individual labels spaced from one another on said continuous base sheet release strip and within the margins thereof by cutting through only said transparent cover sheet, its release sheet and said base sheet within said margins to produce a continuous strip of marginal portions connected by transverse portions thereof and with said cover release sheet extending to one of the edges of said labels and being spaced from the other edge of said labels and separating means for separating said continuous strip of marginal portions connected by transverse portions from said individual labels on said continuous base sheet release strip, said individual labels having said transparent cover sheet adhered directly to a portion only of said labels and with said cover release sheet interposed therebetween in another portion extending to an edge of said labels for subsequently adding information to said other portion and protecting said added information by removing said cover release sheet and adhering said transparent cover sheet directly to said other portions to cover said added information.

4. Apparatus for manufacturing a continuous strip carrying individual longitudinally spaced printed pressure sensitive adhesive labels, having permanently mounted pressure sensitive adhesive transparent hinged covers with release sheets thereon for protectively covering information subsequently added to the label, from a continuous strip base sheet having a pressure sensitive adhesive surface with a continuous strip base release sheet adhered thereto and a continuous strip transparent cover sheet having a pressure sensitive adhesive surface with continuous strip cover release sheet adhered thereto, said apparatus comprising printing means for printing label indicia on said base sheet cover sheet slitting means for continuously slitting only said cover release sheet and removing opposite edge portions thereof to expose opposite edge portions of the pressure sensitive adhesive surface of said transparent cover sheet while maintaining a central portion of said cover release sheet thereon laminating means for laminating said transparent cover sheet to the printed face of said base sheet by adhering thereto the pressure sensitive adhesive surface edge portions of said transparent cover sheet, with said central portion of said cover release sheet interposed between said transparent cover sheet and the printed face of said base sheet cutting means for cutting individual labels spaced from one another on said continuous base sheet release strip and within the margins thereof by cutting through only said transparent cover sheet, its release sheet and said base sheet within said margins to produce a continuous strip of marginal portions connected by transverse portions thereof and with said cover release sheet extending to one of the edges of said labels and being spaced from the other edge of said labels and separating means for separating said continuous strip of marginal portions connected by transverse portions from said individual labels on said continuous base sheet release strip, said individual labels having said transparent cover sheet adhered directly to a portion only of said labels for protection thereof and with said cover release sheet interposed therebetween in another portion extending to an edge of said labels for subsequently adding information to said other portion and protecting said added information by removing said cover release sheet and adhering said transparent cover sheet directly to said other portion to cover said added information.

* * * * *